United States Patent [19]

Carvalko et al.

[11] 4,119,989

[45] Oct. 10, 1978

[54] SYSTEM FOR CONTROLLING CONCENTRATION OF DEVELOPER SOLUTION

[75] Inventors: Joseph R. Carvalko, Bethel; Robert J. Tolmie, Jr., Fairfield, both of Conn.

[73] Assignee: Pitney-Bowes, Inc., Stamford, Conn.

[21] Appl. No.: 756,147

[22] Filed: Jan. 3, 1977

[51] Int. Cl.[2] ..... G03D 13/00

[52] U.S. Cl. ..... 354/298; 354/324; 137/93; 118/646

[58] Field of Search ..... 354/298, 324; 355/10, 355/27, 100, 106; 137/93; 118/646; 250/573

[56] References Cited

U.S. PATENT DOCUMENTS

| | | | |
|---|---|---|---|
| 3,388,652 | 6/1968 | Parrent | 354/298 |
| 3,494,328 | 2/1970 | Maloney | 137/93 |
| 3,561,344 | 2/1971 | Frutiger et al. | 354/298 |
| 3,712,203 | 1/1973 | Kishi et al. | 137/93 |
| 3,791,744 | 2/1974 | Erny et al. | 118/646 |
| 4,021,832 | 5/1977 | Krehbiel et al. | 354/298 |
| 4,023,193 | 5/1977 | Schroter et al. | 354/298 |

*Primary Examiner*—L. T. Hix
*Assistant Examiner*—Alan Mathews
*Attorney, Agent, or Firm*—Martin D. Wittstein; Albert W. Scribner; William D. Soltow, Jr.

[57] ABSTRACT

A system for controlling the concentration of developer solution, which includes a toner concentrate and a carrier, to be substantially equal to a predetermined concentration. The system, which is used in conjunction with a photocopying apparatus, comprises a source of light directed through the solution and a photosensor, on which the light source is focused, that generates an output signal proportional to the amount of light reaching it. A reference signal generator produces a reference signal substantially equal to the photosensor output signal that corresponds to the predetermined solution concentration. A comparator receives both the photosensor output and the reference signals and produces an error signal proportional to the difference between the two. The error signal is used to modulate the amount of time during which a servo mechanism is operated to add toner concentrate to the solution and thereby control solution concentration.

12 Claims, 4 Drawing Figures

Fig. 3.
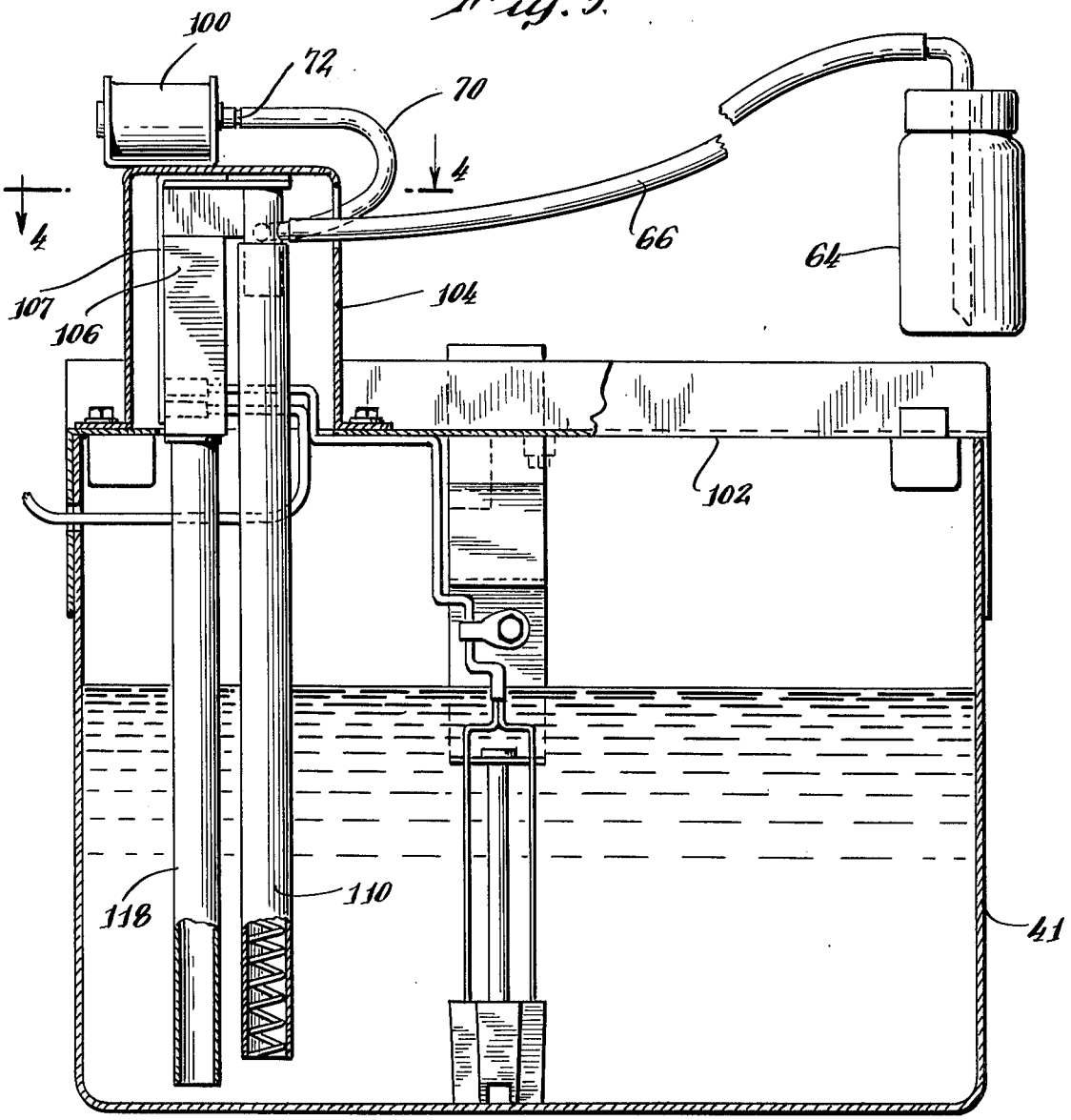
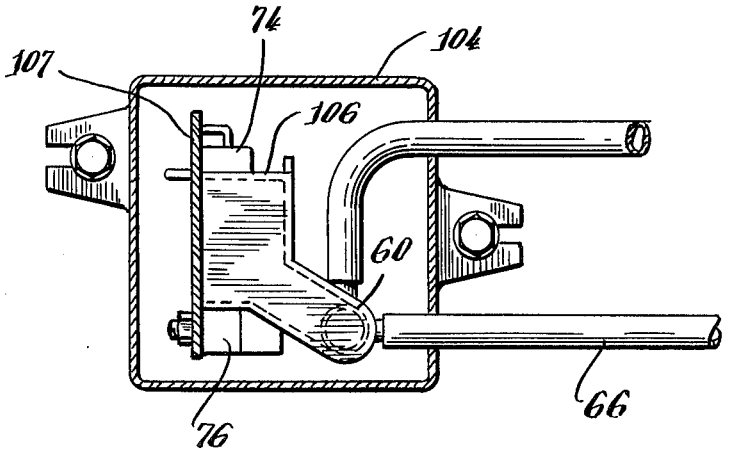
Fig. 4.

SYSTEM FOR CONTROLLING CONCENTRATION OF DEVELOPER SOLUTION

BACKGROUND OF THE INVENTION

1. Field of the Invention

The present invention relates to a system for automatically controlling the concentration of developer solution in a photocopying machine. The developer solution typically comprises toner concentrate, which includes chargeable toner particles, and a vehicle or carrier with which the concentrate is combined.

Photocopying machines are now in widespread use for reproducing all forms of documents. These machines are usually either of the "single component" dry toner type or "double component" wet toner type. In the machines of the second type, a copy sheet having a photoconductive coating is uniformly electrostatically charged. The image of a document to be copied is then projected onto the charged copy sheet while at an imaging station. A conductive ground plate, forming part of the imaging station, is effective to allow discharge of selected areas of the sheet in accordance with the projected image. In this way, a latent electrostatic image is formed on the sheet. The latent image is developed by passing the sheet through a trough containing a toner or developer solution that carries a large number of particles charged oppositely to the charge of the latent image. Accordingly, the particles are attracted to the image areas on the sheet to later be fixed and dried in a well known manner and thereby yield a finished copy.

Toner particles are, of course, removed from the developer solution each time a copy is made. Therefore, if no toner concentrate is added to the solution, the concentration of toner particles therein decreases. However, if acceptable copies are to be made, that is, copies which are adequately developed, the toner concentration should be maintained above a predetermined minimum level. But further, if the toner concentration exceeds certain levels, the copies made will be smudged or grainy. Therefore, the solution concentration must also be maintained below certain maximum levels.

The system of the present invention automatically and accurately controls the toner particle concentration of a developer solution in an electrostatic photocopying machine.

2. Description of the Prior Art

The problem of maintaining the toner particle concentration of the developer solution in an electrostatic photocopying machine within an acceptable range has been considered in the past. For example, some systems intended to provide such control continually add toner particles or toner concentration to the developer while the machine is in operation at a rate correlated to an average rate of particle removal. However, if the copies being made withdraw particles at a rate which deviates substantially from the average rate, then the developer solution cannot be maintained at its preferred concentration.

One automatic system adds toner concentrate to the developer solution until sufficient solution concentration is detected. At that time the concentrate adding mechanism is disabled. However, if the detection device fails, the solution becomes too concentrated or overflows its holding tank. Thus, the systems described above have certain drawbacks.

Another approach to photocopying machine developer solution concentration control is disclosed in U.S. Pat. No. 3,739,800 (Aasen et al.) which describes a system that includes a photocell for detecting the need for additional toner concentrate. The photocell receives varying amounts of light transmitted through a transparent monitoring tube through which the developer solution circulates. If the solution is not concentrated enough, the resistance of the photocell lowers to a level that permits a periodically generated enabling pulse from an electronic control circuit to actuate a solenoid valve. Short timed bursts of toner concentrate are added to the developer solution by actuation of the solenoid at preselected intervals until the concentration of the solution reaches an acceptable level.

The Aasen et al. device also has certain drawbacks. In particular, the amount of toner concentrate added at each interval during which the solenoid is actuated is not controlled nor is the frequency of the intervals altered. The only variable controlled by the device is the number of short bursts of concentrate which are added. Therefore, control of the developer solution concentration is not precise.

SUMMARY OF THE INVENTION

In a preferred embodiment, to be described below in detail, the system of the present invention for controlling concentration of a developer solution, which includes a toner concentrate and a carrier, introduces toner concentrate into the solution in measured quantities calculated to maintain toner particle concentration at a predetermined value.

In its preferred embodiment, the system comprises a source of light directed through the developer solution and focused on a photosensor. The photosensor generates an output signal which is proportional to the amount of light transmitted through the developer solution. A reference signal generator provides a reference signal that is substantially equal to the photosensor output signal generated when toner concentration equals the predetermined value. Both the photosensor and the reference signal generator are coupled to a comparator that compares the output and reference signals and generates an error signal proportional to the difference between them. A servo drive mechanism, which may include a valve and valve actuator, controls the admission of toner concentrate to the developer solution in response to the error signal.

In the preferred embodiment, the system further comprises a periodic pulse generator for pulsing the valve actuator for a finite period of time. A pulse width modulator modulates the width of the pulses generated by the pulse generator in direct proportion with the error signal. Accordingly, when the difference between the photosensor output signal and reference signal is large and, hence, the error signal is large, the width of the pulse generated by the pulse generator is also large. However, when the difference between the output and reference signals is small and, hence, the error signal is small, the periodic pulse generated by the generator is also small.

The system described above is arranged so that when the error signal is at a minimum, the width of the pulse generated by the periodic pulse generator is of insufficient duration to cause the valve actuator to actuate the toner concentrate adding valve. That is, the inertia of the valve actuator and valve is too great to be overcome during the pulse generated at minimum error. However, as the difference between the reference and output signals increases the width of the pulse similarly increases to durations sufficient to actuate the valve through the valve actuator and, thus, add toner to the solution. Therefore, the amount of toner added to the developer solution is determined by the length of time which the concentrate-adding valve is actuated. This length of time is, in turn, determined by the deviation from the preferred concentration of the developer solution. Thus, the system of the present invention precisely controls developer solution concentration at all times during operation of the electrostatic photocopier.

Accordingly, it is an object for the present invention to provide a system for controlling the concentration of developer solution in an electrostatic photocopier both automatically and accurately.

Other objects, aspects, and advantages of the present invention will be pointed out in or will be understood from the following detailed description provided below in conjunction with the accompanying drawings.

BRIEF DESCRIPTION OF DRAWINGS

FIG. 3 is a cross-sectional view taken through plane 3—3 looking toward the left in FIG. 1 of several of the components of the system.

FIG. 4 is a cross-sectional view taken through plane 4—4 in FIG. 3 looking down.

DETAILED DESCRIPTION OF THE PREFERRED EMBODIMENT

Figure 1:
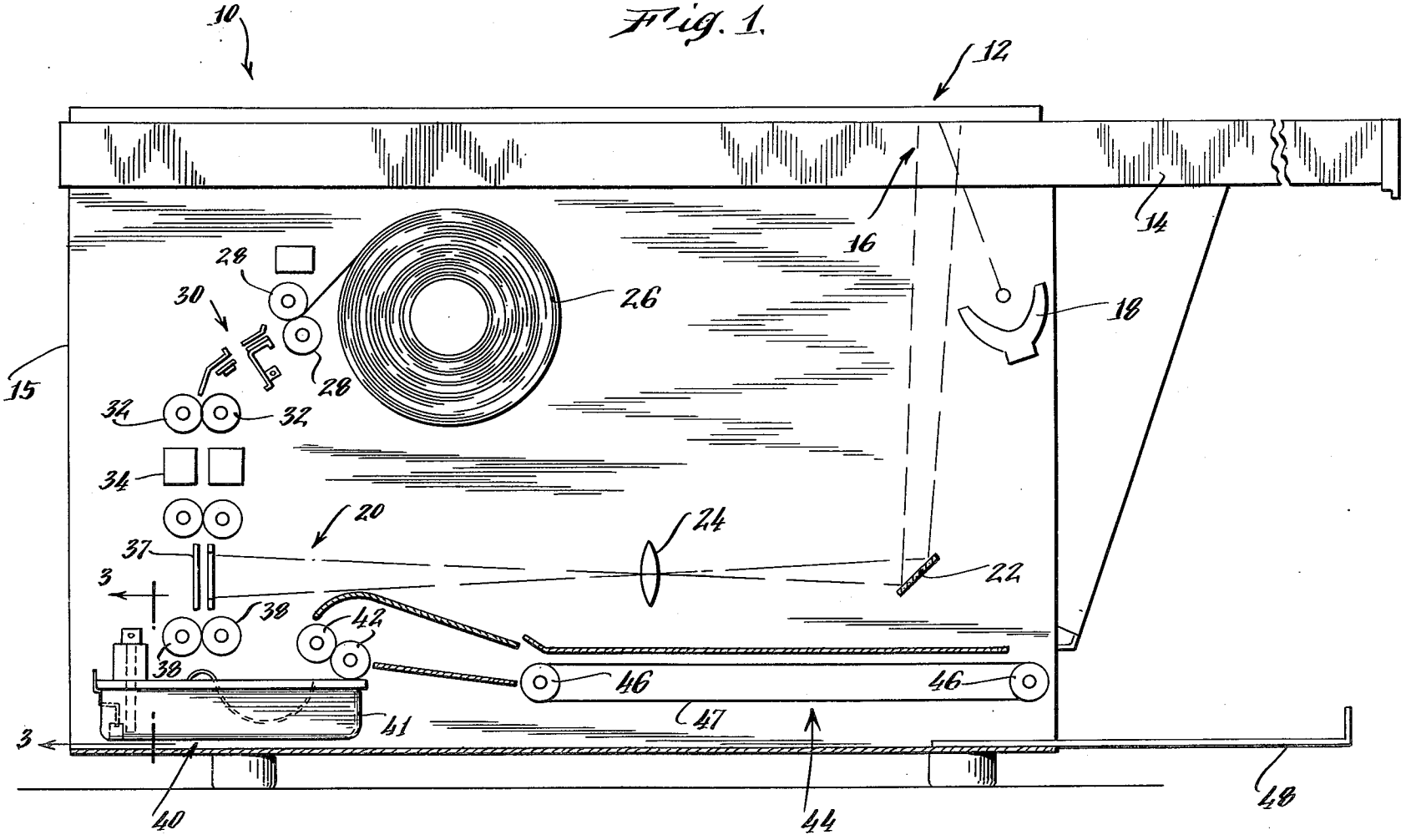
FIG. 1 is a schematic illustration of a photocopying apparatus in which the system of the present invention for controlling the concentration of developer solution is installed.

FIG. 1 schematically illustrates an electrostatic photocopying machine, generally indicated at 10, which is equipped with a system constructed in accordance with the present invention for controlling the concentration of developer solution and is used in a manner described below. As noted above, the developer solution is comprised of a toner concentrate and a liquid toner carrier or vehicle. The toner concentrate comprises a large number of toner particles, which can be electrically charged, mixed in high concentration in a carrier which is miscible in the main solution carrier. The concentration that is controlled by the system of the invention is that of the final solution comprised of the mixed concentrate and carrier.

In order to understand the system of the present invention for controlling concentration of the developer solution it is helpful to first briefly describe an illustrative electrostatic photocopying machine in which it may be installed. This photocopying machine is described in detail in U.S. Pat. No. 3,738,743 (Hoffman et al.) assigned to the assignee of the present invention. Of course, the system may be used with machines which differ from that described in certain of its details. However, the basic principles of operation will remain the same from machine to machine.

The illustrative machine 10 may comprise a reciprocating document carriage, generally indicated at 12, which is mounted on elongated horizontal siderails 14 on top of the photocopier housing 15 for reciprocal movement between a home position at the extreme right of FIG. 1 and a transfer position at the extreme left. This reciprocating document carriage may be of the type described in detail in U.S. Pat. No. 3,697,165 (Morriston et al.) assigned to the assignee of the present invention.

An original document sheet bearing the image to be copied is placed faced down on the carriage and is reciprocated through an illuminating station, generally indicated at 16, that is illuminated by a light source 18 during the return of the carriage 12 from its transfer position to its home position. The illuminated original document image is projected onto an imaging station, generally indicated at 20, by means of a mirror 22 and a lens system diagrammatically illustrated at 24.

Prior to projection of the document image, copy paper having, a suitable photoconductive coating, such as "ELECTROFAX" paper having a zinc oxide coating on one side, is withdrawn from a supply roll 26 by initial feed rollers 28. The copy paper is cut into a desired sheet length, which corresponds to the length of the original document carrying the image being copied, by a knife mechanism 30. Thereafter, the paper is fed by a pair of feed rollers 32 to a charging device such as a corona charger 34 which uniformly charges the photoconductive coating on the sheet.

From the corona charger unit 34, a third pair of feed rollers 36 feeds the uniformly electrostatically charged copy paper to the imaging station 20. This imaging station includes a conductive ground plate 37 which is effective to allow discharge of selected areas on the photoconductive coating of the copy sheet when struck in accordance with the image of the original document. Moreover, the copy paper is fed through the imaging station in synchronism with movement of the document through the illuminating station. In this way, the entire document is scanned and projected in proportion onto the copy sheet. The image of the indicia born by the original document is thus transformed into a corresponding latent electrostatic image on the photoconductive coating of the copy paper. This latent electrostatic image is identified by the charged areas that remain on the copy sheet after non-image areas are permitted to discharge at the station 20.

The copy sheet is then fed by a fourth pair of rollers 38 through a development station, generally indicated at 40, where the latent electrostatic image is developed by the developer solution which is held in a tank 41. The toner particles in the solution are charged oppositely to the latent electrostatic image on the copy sheet and are, therefore, attracted to the electrostatic image in order to develop it, in a well-known manner.

From the development station 40, a fifth pair of feed rollers 42 convey the developed copy sheet to a drying station, generally indicated at 44, where the developed image on the copy paper is fixed. Feed rollers 46 on which a transporting belt 47 is mounted ultimately convey the now developed copy sheet to a tray 48 where successive copies may be accumulated for removal by an operator.

Figure 2:
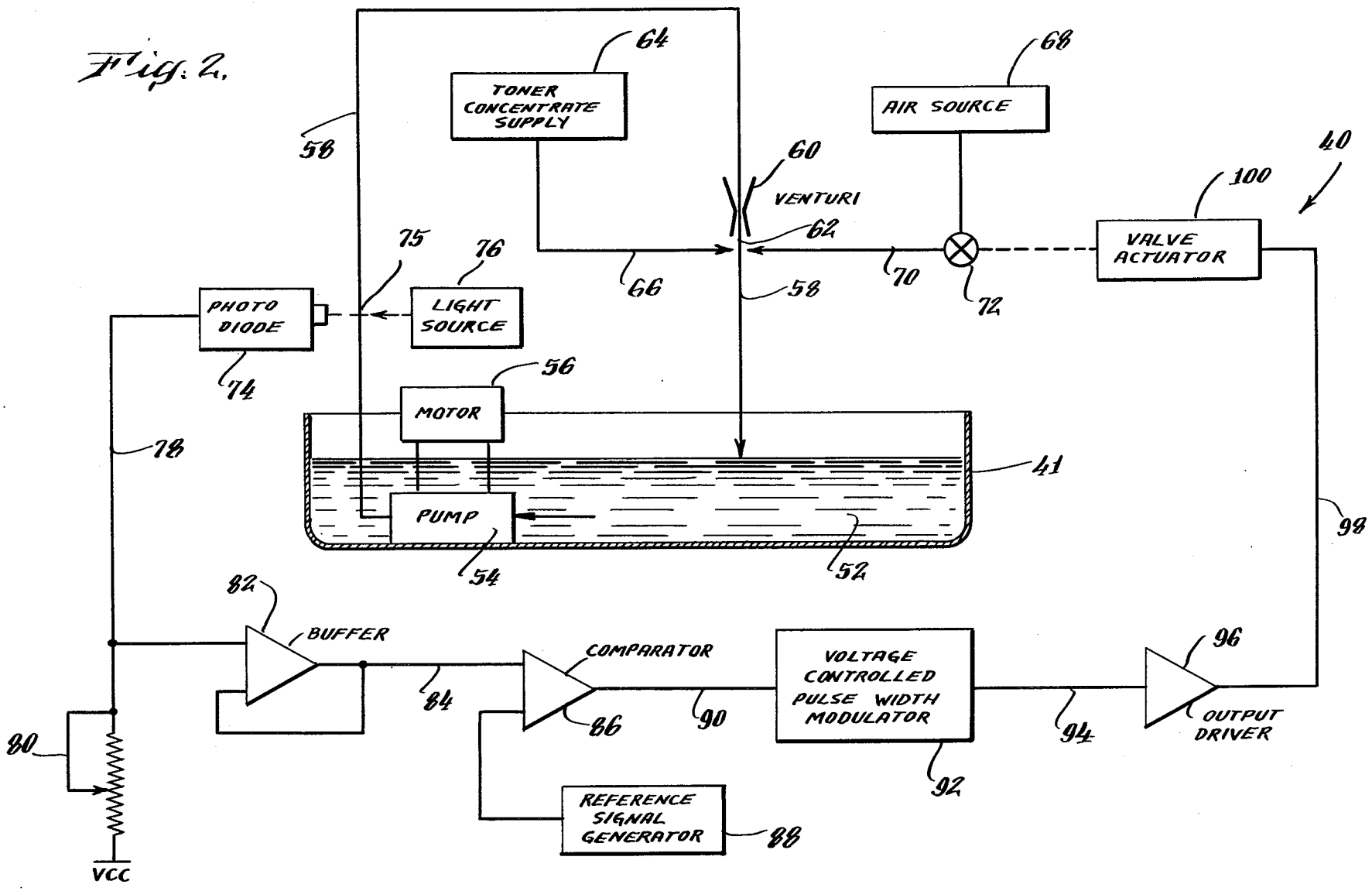
FIG. 2 is a diagrammatic representation of the system for controlling the concentration of the developer solution.

The concentration of the developer solution held in the tank 41 is automatically and accurately controlled by the system of the present invention so that the photocopying machine 10 may uniformly produce acceptable copies. In particular, the concentration is maintained at a predetermined value that is prescribed for producing the best copies. As shown in FIG. 2, which is diagrammatically illustrative of this system, the development station tank 41 holds developer solution 52 of toner concentrate and carrier. The solution is continually circulated by a pump 54 powered by a motor 56 through an open loop 58 to insure that the particles from the toner concentrate are continually mixed with the carrier to create a uniform dispersion.

When the concentration of toner particles falls below the predetermined value, the apparatus of present invention operates to add more concentrate and, hence, more toner particles automatically in a manner to be described below. Since the toner concentrate is highly abrasive, it is desirable to provide a mechanism for adding it to the developer solution which has no moving parts that might wear and thus prove unreliable. This mechanism for adding more toner particles includes a venturi 60 which effects a pressure drop at its downstream end 62 in the open loop 58. The pressure drop is used to draw toner concentrate from a supply 64, through a conduit 66 tapped into loop 58, into the continuously circulating solution at appropriate times. Addition of toner is prevented, however, at all times except when desired, by a source of air 68 which enters the open loop 58 through a conduit 70, at substantially the same location as the toner concentrate conduit 66. When concentrate is to be added, the source of air is closed by means of a valve 72 so that the low pressure downstream of the venturi 60 will draw concentrate into the loop 58.

The control system of the present invention operates the valve 72 to add toner concentrate in such quantities that the concentration in the developer solution remains substantially at the predetermined value. It does so by comparing a signal indicative of the solution concentration with a reference signal indicative of the preferred concentration, generating an error signal proportional to the difference between the two, and adding toner concentrate to the solution in accordance with the error signal.

Since the toner particles are opaque, the optical density of the developer solution is dependent upon its concentration. That is, the more highly concentrated the developer solution the denser it becomes. Conversely, the less concentrated the less dense it becomes. Accordingly, the amount of light from a given source transmitted through the developer solution is an indication of the solution concentration. Therefore, the system comprises a photosensor in the form of a photodiode 74 which is positioned upstream of the venturi 60 and the connection of loop 58 with conduits 66 and 70. A light source, preferrably in the form of a tungsten bulb 76, is focused on the photodiode through a transparent section 75 of the loop 58. The photodiode 74 is an electrical component which produces an output voltage or signal which is linearly related to the amount of light incident on it. Thus, the more light transmitted to the photodiode the greater its output signal.

The photodiode 74 is connected by line 78 to a variable resistor 80 and these components collectively produce the output signal indicative of solution concentration. Both the resistor 80 and photodiode 74 are connected in parallel to a buffer 82 which isolates and amplifies the output signal and conducts it on line 84 to a comparator 86. The second input to the comparator is a source 88 of a reference voltage or signal. The comparator then generates an error signal which is proportional to the difference between the photodiode-resistor output and reference signals. The error signal is conducted on line 90 to a voltage controlled pulse width modulator (VCPWM) 92 that includes a multivibrator. A pulse of known period, for example, 15 seconds is generated by the multivibrator, and is conducted on line 94 to an output driver or amplifier 96. However, the width of the pulse is modulated by the VCPWM 92 in accordance with the error signal received thereby. The output driver 96 is, in turn, connected on line 98 to a servo mechanism or valve actuator, for example a solenoid, for the air source valve 72.

The valve actuator 100 is enabled to actuate the valve 72 by the periodic pulses received on line 98. However, whether or not the actuator actually operates valve 72 is determined by the width of the pulse received. As noted above, this width is modulated in accordance with the error signal which is dependent on the developer solution density detected by the photodiode.

The system is operated as follows: The reference voltage generated by source 88 is fixed at a constant value. The system is then calibrated by adjusting the variable resistor 80 until the error signal from the comparator on line 90 is zero or an arbitrary minimum value when the developer solution has its average desired concentration and, hence, optical density. Any deviation from this average concentration and, hence, deviation from the average density will change the output from the photodiode and, therefore, change the input to the buffer 82 and comparator 86. Accordingly, the error signal on line 90 from the comparator will increase proportionally to the difference between the reference voltage and the output signal from the photodiode. The error signal on line 90 is used by the VCPWM 92 to modulate, in direct proportion, the width of the pulse generated by the multivibrator contained therein. That is, the larger the error signal, the larger the pulse width or longer the pulse generated on line 94 and 98. The longer the pulse, the longer valve 72 is operated by valve actuator 100 to add more toner concentrate to the developer solution.

The pulse width of the signal generated by the VCPWM 92 at zero error signal on line 90 is set to be of insufficient duration for the valve actuator to overcome its inherent inertia and the inertia of valve 72. Therefore, even though the valve actuator is pulsed at zero error signal, valve 72 is not operated to add toner concentrate to the developer solution. However, the width of the pulse and, hence, the time during which the actuator is turned on ($T_{on}$) is a function of the input voltage or signal from the photodiode ($V_{input}$) minus the reference voltage or signal ($V_{ref}$) multiplied by a constant (K) indicative of amplification in accordance with the following equation:

$$T_{on} = (V_{input} - V_{ref})K + T_{on\ min}$$

$T_{on\ min}$ is the minimum time the valve is open when $V_{input}$ is less than or equal to $V_{ref}$. The magnitude of the error signal which is proportional to $(V_{input} - V_{ref})K$, however, has no effect on the period of the pulse. This period is set to allow the carrier and concentrate to mix completely after each addition of concentrate.

The maximum pulse width may be approximately 8 to 10 times minimum pulse width. It is desirably at least 5 times minimum pulse width to permit a high degree of latitude in the amount of toner concentrate added to the developer solution for any given actuation of valve 72. This feature permits the developer solution to be brought to the desired concentration rapidly.

The apparatus described above accordingly senses the exact concentration of the developer solution at any give time and adds toner concentrate to the solution in amounts needed to rapidly bring the concentration to its desired level. This rapid response is achieved since the amount of time during which toner concentrate is added to the solution is controlled. Therefore, the amount of concentrate added to the solution in accordance with the difference between desired solution concentration and actual solution concentration is also controlled. Accordingly, a substantial improvement is made over systems which merely add fixed amounts of toner concentrate at known intervals until the solution is brought to the desired concentration.

The physical apparatus embodying the present invention is illustrated in FIGS. 3 and 4. As shown there, a support platform 102 is provided above the solution tank 41. A square housing 104 is mounted above the platform and encloses a chamber 106 which is supported by a plate 107. The chamber 106 is connected to an input conduit 118 by means of the pump 54 (not shown in FIG. 3). Similarly, an outlet conduit 110 returns downwardly from chamber 106 to the tank 41. Accordingly, developer solution is circulated through the chamber.

As shown in FIG. 4, the light source 76 is mounted on one side of the chamber 106 and the photodiode 74 is mounted on an opposite side. Accordingly, the light source is focused on the diode through a fixed distance which is filled with developer solution during machine operation.

The chamber is also equipped with the venturi 60 which is in operative relation to inlet conduit 66 from the concentrate supply 64. The air source is similarly conducted to the chamber 106 by conduit 70. The valve actuating solenoid 100 is mounted on top of the housing 104 to control a valve 72 and, as noted above, to control supply of air through conduit 70.

As can be seen from the FIGURES, the basic embodiment of the present invention is relatively compact yet extremely effective in controlling toner density. Further, the toner density control system of the present invention constitutes a substantial improvement over prior apparatus.

Accordingly, although a specific embodiment of the present invention has been described above in detail, it is to be understood that this is for purposes of illustration. Modifications may be made to the described structure by those skilled in the art in order to adapt the toner density control to particular applications.

What is claimed is:

1. A system for controlling the concentration of a liquid developer solution, which includes a liquid toner concentrate and a liquid carrier, to be substantially equal to a predetermined concentration in a photocopying apparatus; said system comprising:

A. a source of light directed through the developer solution;

B. photosensor means, on which said source is focused, for generating an output signal proportional to the amount of light transmitted through the developer solution thereto;

C. reference means for generating a reference signal substantially equal to a photosensor means output signal corresponding to the predetermined developer solution concentration;

D. comparator means for comparing said output and reference signals and generating an error signal proportional to the difference therebetween;

E. servo means operable for adding at least one of the toner concentrate and the carrier to the developer solution in response to said error signal;

F. means for periodically enabling said servo means; and

G. means coupled to said comparator and to said periodic enabling means for operating said servo means during each enabling period for a variable interval of time dependent upon said error signal of said comparator whereby relatively small variable amounts of the additive are periodically added to the solution in order to maintain its predetermined concentration.

2. The system for controlling the concentration of a developer solution in a photocopying apparatus as claimed in claim 1 wherein said light source and photosensor means are spaced by a fixed distance between which a fixed thickness of developer solution passes.

3. The system for controlling the concentration of a developer solution in a photocopying apparatus as claimed in claim 2 wherein said photosensor means in a photodiode.

4. The system for controlling the concentration of a developer solution in a photocopying apparatus as claimed in claim 1 wherein said servo means comprises:

1. valve means for controlling addition, of at least one of the toner concentrate and carrier to the to the toner mix; and
2. means for actuating said valve means during said variable intervals of time.

5. The system for controlling the concentration of a developer solution in a photocopying apparatus as claimed in claim 4 wherein:

3. said periodic enabling means (F) comprises a periodic pulse generator for pulsing said valve actuating means; and
4. said means operating said servo means (G) comprises a pulse width modulator for modulating the width of pulses generated by said pulse generator in proportion to the error signal to control the duration of the time interval during which said actuating means operates said valve means.

6. The system for controlling the concentration of a developer solution in a photocopying apparatus as claimed in claim 5 wherein said pulse width modulator is adapted to increase the pulse width to at least 5 times the pulse width at minimum error signal.

7. The system for controlling the concentration of a developer solution in a photocopying apparatus as claimed in claim 5 wherein the pulse width generated by said pulse generator at minimum difference between said photosensor output signal and said reference signal is of insufficient duration to cause said valve actuating means to actuate said valve.

8. A system for controlling the concentration of a liquid developer solution, which includes a liquid toner concentrate and a liquid carrier, to be substantially equal to a predetermined concentration in a photocopy apparatus; said system comprising:

A. a source of light directed through the developer solution;

B. photosensor means on which said source is focused for generating a signal proportional to the amount of light transmitted through the developer solution thereto;

C. reference means for generating a reference signal substantially equal to a photosensor output signal corresponding to the predetermined developer solution concentration;

D. comparator means for comparing said output and reference signals and for generating an error signal proportional to the difference therebetween;

E. servo means for adding the toner concentrate to the developer solution;

F. a pulse generator coupled to said servo means for generating periodic enabling pulses thereto that signal said servo means to add toner concentrate to the solution during an interval of time corresponding to duration of the enabling pulse; and G. a pulse width modulator coupled to said comparator means and said pulse generator for modulating the width of each enabling pulse generated thereby for a variable interval of time proportional to the magnitude of said error signal whereby relatively small, variable amounts of liquid toner concentrate are added to the developer solution during periodic intervals of time in order to maintain the solution at the predetermined concentration.

9. The system for controlling the concentration of a developer solution in a photocopying apparatus as claimed in claim 8 wherein said light source and photosensor means are spaced by a fixed distance between which a fixed thickness of developer solution passes.

10. The system for controlling the concentration of a developer solution in a photocopying apparatus is claimed in claim 8 wherein said servo means comprises:

1. valve means for controlling addition of at least one of the toner concentrate and carrier to the developer solution; and carrier to the developer solution; and
2. means responsive to said enabling pulses for actuating said valve means.

11. The system for controlling the concentration of a developer solution in a photocopying apparatus as claimed in claim 8 wherein said pulse width modulator is adapted to increase the pulse width to at least 5 times the pulse width at minimum error signal.

12. The system for controlling the concentration of a developer solution in a photocopying apparatus is claimed in claim 9 wherein the pulse width generated by said pulse width generator at minimum difference between said photosensor output signal and said reference signal is of insufficient duration to cause said servo means to actuate said valve.

* * * * *